United States Patent [19]

Ikeura et al.

[11] Patent Number: 4,908,667

[45] Date of Patent: Mar. 13, 1990

[54] ELECTROPHOTOGRAPHIC COPYING APPARATUS

[75] Inventors: Hiroo Ikeura; Yoshiyuki Yamaji, both of Wakayama; Hajime Murakami, Kusatsu; Yoshikazu Tamaki, Wakayama; Ritsuo Tanaka, Osaka, all of Japan

[73] Assignees: Noritsu Koki Co., Ltd., Wakayama; Ishihara Sangyo Kaisha, Ltd., Osaka, both of Japan

[21] Appl. No.: 219,636

[22] Filed: Jul. 15, 1988

[51] Int. Cl.[4] ..... G03G 15/10; G03G 27/60

[52] U.S. Cl. ..... 355/256; 355/312; 355/326

[58] Field of Search ..... 355/326, 327, 256, 312, 355/293, 318, 310, 200, 29, 73

[56] References Cited

U.S. PATENT DOCUMENTS

| | | | |
|---|---|---|---|
| 3,810,693 | 5/1974 | Matsumoto et al. | 355/327 |
| 4,175,857 | 11/1979 | Ragg et al. | 355/73 X |
| 4,247,191 | 1/1981 | Grace et al. | 355/256 X |
| 4,402,592 | 9/1983 | Schön et al. | 355/73 |

*Primary Examiner*—A. T. Grimley
*Assistant Examiner*—William Royer
*Attorney, Agent, or Firm*—Armstrong, Nikaido, Marmelstein, Kubovcik & Murray

[57] ABSTRACT

A photographic copying apparatus for reproducing an original on photosensitive paper. A roll of photosensitive paper mounted in a magazine is fed downwardly and cut into sheets. Each sheet is sucked to a vertically arranged suction conveyor and fed down. At a predetermined position, the feed of the sheet stops. An exposure table which is turnable and movable between two points is turned and pressed against the sheet on the conveyor. The suction conveyor stops sucking the sheet while the exposure table starts sucking it, so that the sheet is handed over to the latter. The table now carrying the sheet moves toward the expsoure unit. On its way, it is turned and passed under a corona charger. As the table reaches and the exposure unit, it is turned again and the light reflected by an original is shed on the sheet for light exposure. The table is then turned to bring its sheet carrying side down and moved in an opposite direction toward the conveyor. The sheet is brought into contact with one of several kinds of developing solutions in tanks which are adapted to be raised into contact with the sheet one after another. Any excess solution applied to the sheet is removed by a squeezer. After this first development cycle, the table is turned by 180 degrees and moved toward the exposure unit again for another cycle of development. This cycle is repeated as many times as the number of colors used.

2 Claims, 12 Drawing Sheets

10
39
26
23
22'
25
70
24
22
20
21
21'
11
12
S
18
19
38

20
24
22'
22
10
S
8
11

S
10
8
11

57
11
8
S
10
54

8
10
S
11
44

20
24
22'
22
36
37
11
S
10
8
58
65
66
64
63
44
21
21'
31
32
34

ELECTROPHOTOGRAPHIC COPYING APPARATUS

The present invention relates to an electrophotographic copying apparatus which can easily and faithfully reproduce a sharp and vivid image of an original.

One process for electrophotographically reproducing a photocopy is well known as the PPC Copying Process. It comprises the steps of electrifying uniformly by corona charge a photosensitive drum having on its surface a photosensitive layer made of an inorganic material such as selenium or cadmium sulfide or an organic material; exposing the drum to light based upon the original to form an electrostatic latent image corresponding to the original; developing it with dry toner powder to create a toner image on the drum; and transferring the toner image onto a plain paper. Also, the above-described developing cycle has to be repeated three or four times per color in order to obtain a multicolor photocopy. This process known as the PPC Color Copying Process is gradually gaining popularity.

But in this process, since the toner images formed on the photoseniitive drum have to be transferred onto the paper several times particularly for color copying, the finished photocopy tends to suffer from poor color registration. Also, since an electrostatic latent image is formed by the so-called scanning exposure in which at least one of the original, light source, lens and mirror has to be moved in synchronization with the rotation of the photo-sensitive drum, a blurred photocopy often results from poor synchronization. Furthermore in this process, it is difficult particularly for color copying to reproduce a pictorial, high-quality photocopy because the development using dry toner powder cannot yet produce a photocopy satisfactory in grain fineness and resolution.

Besides the PPC process, there is known another process in which photosensitive sheet having a photosensitive layer made of a photosensitive material such as zinc oxide is corona charged as in the PPC Process and then subjected to scanning exposure while being carried on a conductive conveyor drum to form an electrostatic latent image. It is then developed to create a toner image directly upon the photosensitive sheet to produce a photocopy, or produce what is called a direct master for making a printing plate in offset printing. A multicolor photocopy is produced by repeating the process several times. This process is called the CPC Color Copying Process.

The inventors took notice of the fact that an electrophotocopy produced by use of titanium dioxide as a photo-conductor exhibits an excellent continuous gradient, and tried to produce a high-quality photocopy which cannot be obtained by the PPC Process, by a process in which is used photosensitive sheet having a photosensitive layer made of e.g. titanium dioxide, electroconductive base sheet or paper having a zinc oxide layer, plastic film coated with an electroconductive layer, metal deposited paper, metal deposited plastics film or metal plates and the electrostatic latent image formed on the photosensitive sheet is subjected to wet development by use of a liquid developing agent having toner grains dispersed. Although the color photocopies produced by this process are excellent in grain fineness and gradient, their image qualities are not satisfactory. They have learned through those trials that in order to readily and stably produce a high-quality photocopy, it is necessary to solve such problems as poor synchronization during scanning exposure or poor resolution resulting from a curved surface on the conductive conveyor drum.

It is required nowadays to electrophotographically produce pictorical and high-quality photocopies, especially color photocopies, which are comparable in consecutive gradient, grain fineness and resolution to those produced by the silver salt photographic copying process. After many trials, the inventors have found that in order to produce high-quality photocopies by the CPC process in a rather simple and stable manner with an apparatus which is simple in construction and compact in size, it is the best way to place the photosensitive paper to be developed on a flat surfaced carrier table which is rotatable and movable between two points so that the photosensitive sheet will be electrostatically charged, exposed to light and developed one step after another in a predetermined order. Also it is preferable to hold the carrier table in an upright position when the photosensitive sheet on the table is exposed to light. With this arrangement, the problems with the prior art apparatus as mentioned above are solved and pictorial and high-resolution photocopies can be produced stably in a short time. Further, the size of the apparatus can be kept small.

It is an object of the present invention to provide an electrophotographic copying apparatus which obviates the abovesaid shortcomings, which has a rather simple construction and which can create a high-quality image.

In accordance with the present invention, there is provided an electrophotographic copying apparatus comprising a carrier means for transferring a photosensitive sheet including a reciprocating plate movable between two positions, a rotary shaft rotatably mounted on the reciprocating plate and an exposure table fixedly mounted on the rotary shaft and adapted to suck and support the photosensitive sheet, a conveyor means provided near one of the two positions and including an endless suction belt for feeding the photosensitive sheet up and down, the conveyor means being adapted to exchange the photosensitive sheet between the suction belt and the exposure table by turning on and off suction force with the photosensitive sheet sandwiched therebetween, a corona charging means for electrostatically charging the photosensitive sheet disposed in the path of travel of the carrier means, a light exposure means disposed near the other of the two positions and adapted to irradiate the photosensitive sheet on the exposure table which is held in an upright position with light reflected by an original, and a developing means for bringing the photosensitive sheet exposed to light into contact with a developing solution.

The photosensitive sheet is fed downwardly by the suction belt of the conveyor unit to a predetermined position, where the sheet is handed over to the exposure table of the carrier unit. The carrier unit now carrying the sheet moves toward the other end of its reciprocating movement. On its way, the sheet is corona charged by the corona charger. When the carrier unit reaches the other end and stops there, the light reflected by the original irradiates the sheet at a right angle to subject the sheet to light exposure. After the exposure, the carrier unit is moved in an opposite direction. On its way, the sheet is brought into contact with a developing solution having toner dispersed therein for development. The abovesaid steps are repeated as many times as the number of kinds of color toner. Thus a toner image is created on the photosensitive sheet. The developed sheet is now handed back to the suction belt and fed upwardly and discharged.

In accordance with the present invention, the exposure table capable of reciprocating between two positions receives a photosensitive sheet at one position and moves to the other position where the table turns to hold the photosensitive sheet vertically. In this state, the light reflected by the original and passed through one of the color separation filters and a lens hits against the sheet at a right angle for stationary exposure. This arrangement will allow a plurality of electrostatic latent images created by light exposure to be stacked in right register with one another. Thus, the developed image is of high-quality without any poor registration, and photocopies can be reproduced easily and stably on photosensitive sheets.

Particularly in color copying in which a plurality of exposures are carried out repeated, the electrostatic latent images are free from poor registration.

After each light exposure step, the photosensitive sheet is brought into contact with a developing solution having a corresponding type of color toner dispersed. Since the electrostatic latent images are in register with one another, color toner images formed based upon them are also in exact register with one another. Thus a high-quality photocopy is readily and reliably produced by the CPC electrophotographic method.

Other advantages of the present invention are that the entire apparatus is of a rather simple construction and compact in size and that the process time is short.

Other objects and features of the present invention will become apparent from the following description taken with reference to the accompanying drawings, in which.

FIGS. 23—26 are views showing how the pivotable sheet guide plate is controlled; and FIGS. 27–30 are schematic views showing in what order the exposure table is turned to bring the photosensitive sheet to desired positions.

Figure 1:
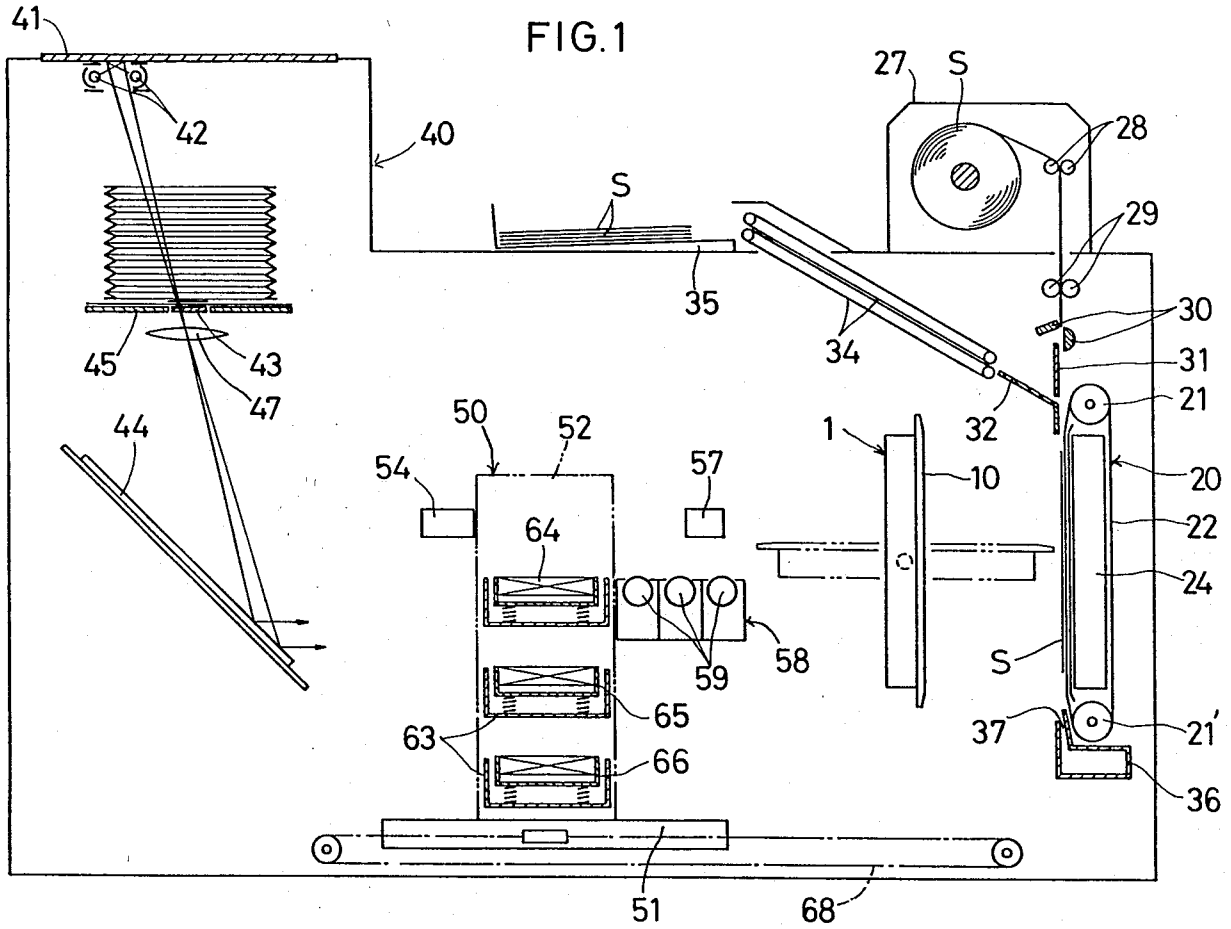
FIG. 1 is a schematic view of the electrophotographic copying machine embodying the present invention.

Now referring to the drawings, FIG. 1 shows generally the color electrophotographic copying apparatus in accordance with the present invention. But, the present invention is not limited to a color copying apparatus. It includes a carrier unit 1 for transporting a photosensitive sheet S, a sheet conveyor unit 20 for exchanging photosensitive sheets S with the carrier unit 1, a corona charger 54 for charging the photosensitive sheet S on the carrier unit 1, an exposure unit 40 for subjecting the photosensitive sheet S on the carrier unit 1 to light exposure, and a development unit 50.

Figure 2:
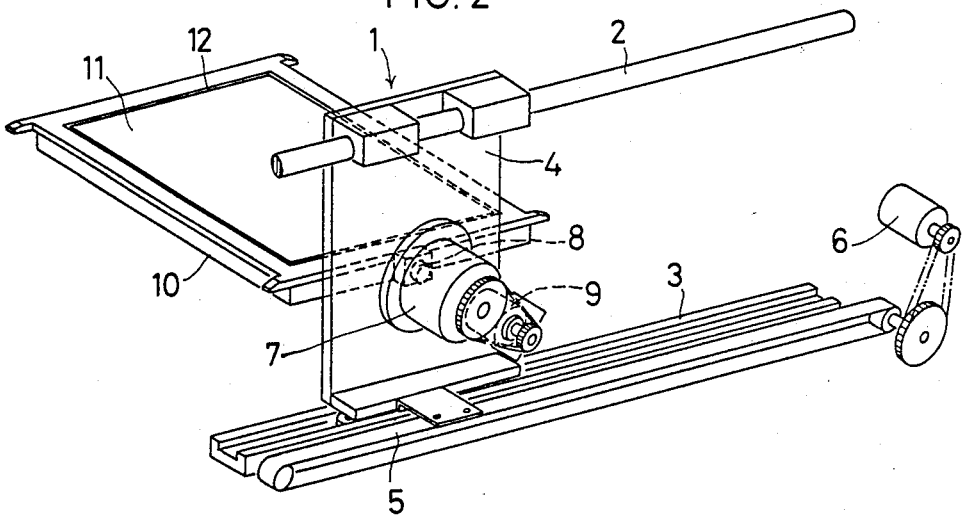
FIG. 2 is a perspective view of the carrier unit.
Figure 3:
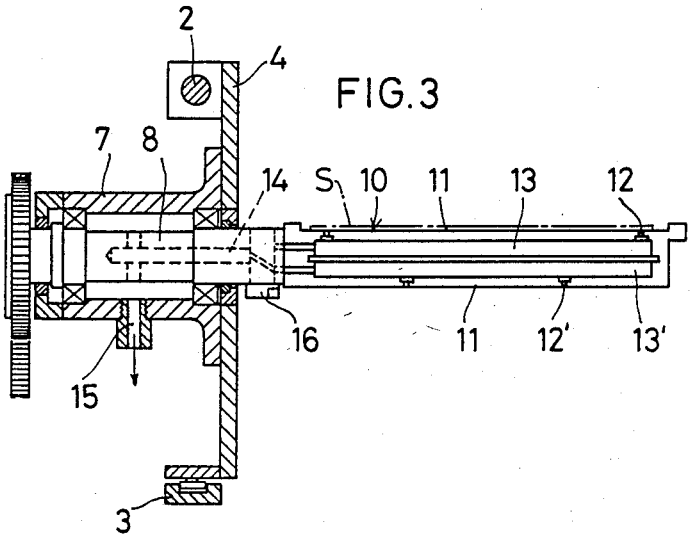
FIG. 3 is a vertical sectional view of the same.

FIGS. 2 and 3 show the details of the carrier unit 1. A reciprocating plate 4 has its top supported by a horizontal slide shaft 2 and its bottom supported by a linear rail 3 and has part of its bottom secured to an endless belt 5 extending in parallel with the linear rail 3. The belt 5 is driven by a motor 6 to reciprocate the plate 4.

On the plate 4, a hub 7 is mounted which carries a rotary shaft 8 adapted to be rotated by a motor 9 mounted on the reciprocating plate 4. An exposure table 10 has one side thereof secured to a protruding end of the rotary shaft 8.

The exposure table 10 has a photosensitive sheet supporting plate 11 formed with a suction groove 12 communicating with a chamber 13 formed in the table 10. (FIG. 3) The chamber 13 communicates with the interior of the hub 7 through a bore 14 formed in the rotary shaft 8. The hub 7 is provided with a suction port 15. A suction hose (not shown) is connected to the suction port 15 to draw the air in the chamber 13 and apply suction force to the groove 12 so that the photosensitive sheet will be sucked to the supporting plate 11.

As shown in FIG. 3, the exposure table 10 may be provided at both sides thereof with sheet supporting plates 11 formed with suction grooves 12 and 12'. In that case, the table 10 is provided with two chambers 13 and 13' communicating with the grooves 12 and 12', respectively. Further, a changeover valve 16 is provided so that the bore 14 will be put into communication with one of the chambers 13 and 13'. Thus one of the supporting plates 11 is selectively used by controlling the valve 16. The photosensitive sheet S closely adheres at its peripheral area to the supporting plate 11 when sucked through the suction groove 12 or 12'. This will prevent a developing solution for development from invading onto its back side via its edge.

Figure 4:
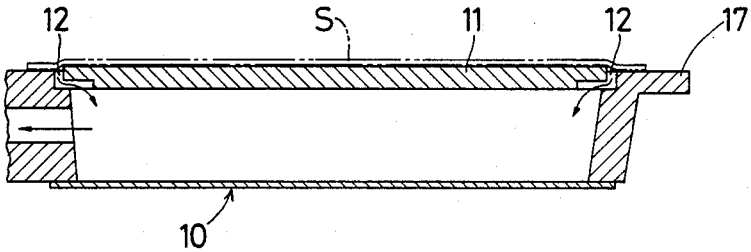
FIG. 4 is a sectional view of another example of the exposure table.

As shown in FIG. 4, the table 10 may have one supporting plate. The supporting plate should preferably have a sheet supporting surface which is higher than its peripheral portion 17 outside the groove 12 so that the photosensitive sheet S will closely adhere at its peripheral portion to the lower peripheral portion 17 of the supporting table. This arrangement will effectively prevent the developing solution from invading into the back side of the photosensitive sheet over its edge.

Figure 5:
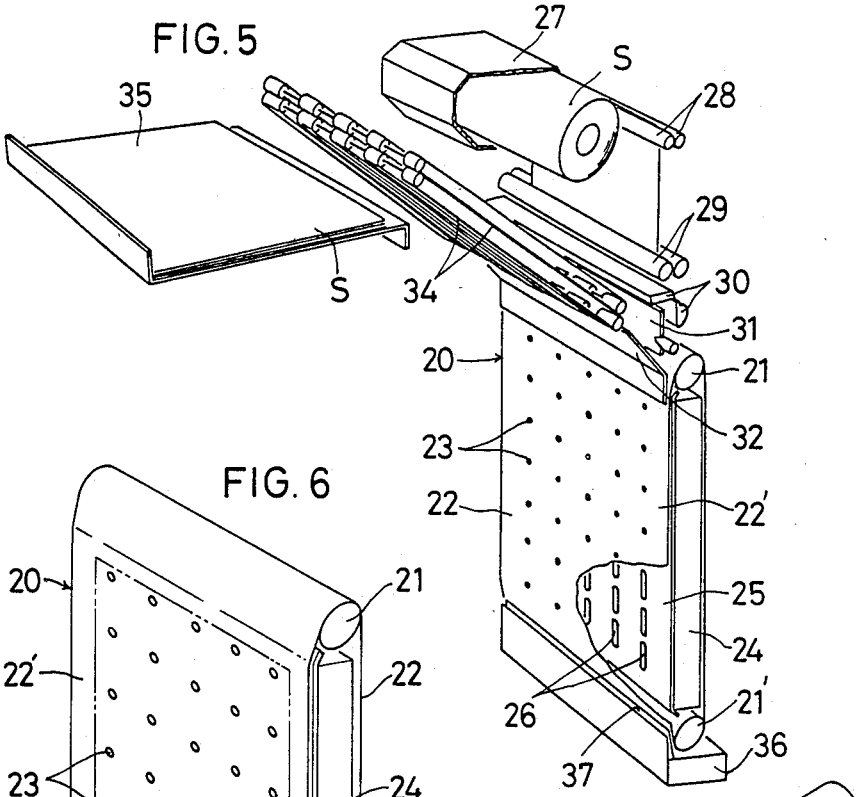
FIG. 5 is a partially cutaway perspective view of the sheet conveyor unit.

The conveyor unit 20 for exchanging photosensitive sheets S with the carrier unit 1 is provided at one end of the travel of the carrier unit 1. (FIG. 1) As shown in FIG. 5, the conveyor unit 20 has a pair of vertically arranged rollers 21 and 21' and an endless suction belt 22 put around the rollers 21 and 21'. The belt 22 is formed uniformly over its entire surface with suction apertures 23.

There is provided a suction box 24 between the front and back sides of the belt. The box 24 is provided at its front side facing a sheet carrying side 22' of the belt 22 with a belt guide plate 25 formed with suction apertures 26. Evacuating the suction box 24 will apply a suction force to the suction apertures 23 at the sheet carrying side 22' of the belt.

Over the suction belt 22, a magazine 27 is provided having a pair of guide rollers 28 and carrying a roll of photosensitive sheet S. A web of paper is rolled out of the magazine 27 so as to be fed downwardly through the guide rollers 28 and another pair of feed rollers 29. The web is fed down by the rotation of the feed rollers 29. The feed rate is calculated from the number of revolutions of the feed rollers 29. When the web is fed by a predetermined length to such a position that its leading end is disposed at the upper portion of the carrying side 22' of the suction belt 22, a cutter 30 provided under the rollers 29 will cut the web S. The moment the web S is cut, the suction box 24 sucks it and the suction belt 22 moves to transport it to a reference position. In the preferred embodiment, the reference position is the horizontal plane including the axis of the rotary shaft 8. The sheet S is fed downwardly until its center coincides with the reference position.

Below the cutter 30, there is provided a pivotable guide plate 31 for switching the direction of travel of the sheet S. While the web rolled out of the magazine 27 is being fed downwardly toward the suction belt 22, the guide plate 31 is perpendicularly positioned. When the sheet S is fed upwardly by the suction belt 22 after having been subjected to a development treatment, the guide plate 31 is inclined to guide it obliquely and upwardly in cooperation with a fixed guide 32 provided below the guide plate 31. It will be described later how the pivotable guide plate 31 is controlled to switch the direction of travel of the sheet S.

Ahead of the fixed guide 32, a pair of delivery conveyors 34 are provided. At their delivery end, a stacker table 35 is disposed upon which the developed photosensitive sheets S are stacked one upon another.

There is provided a hot air blower box 36 under the suction belt 22. The hot air blown out of its outlet port 37 flows upwardly along the front surface of the carrying side 22' of the belt 22 to dry the developed sheet S in the upward flow.

Figure 6:
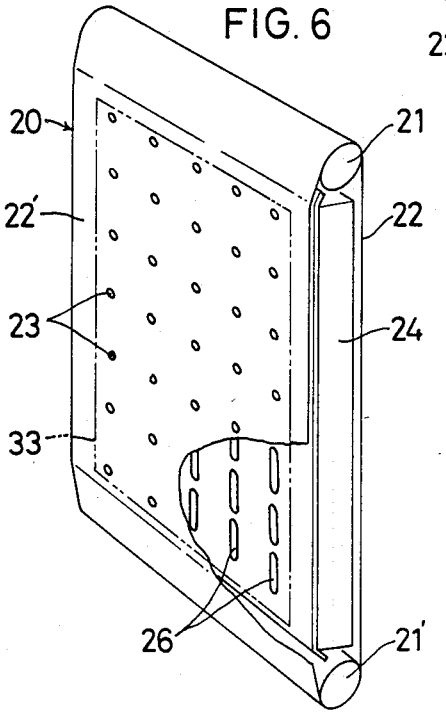
FIGS. 6 and 7 are perspective views showing a varied form of the sheet conveyor unit.
Figure 7:
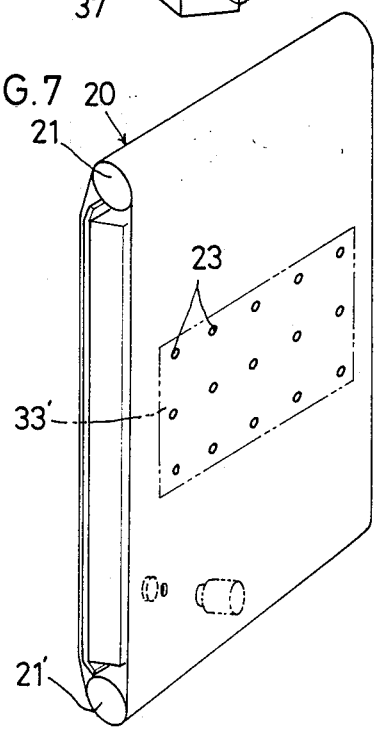

As shown in FIGS. 6 and 7, the suction belt 22 may be provided with two oppositely positioned suction portions 33, 33', one portion 33 having a larger area than the other portion 3'. One of the suction portions may be selected according to the size of the photographic sheet S and moved by a predetermined distance upwardly or downwardly along the belt guide plate 25 with the sheet sucked thereto.

The movement of the suction belt 22 may be controlled so that the selected suction portion will reciprocate between one of the rollers 21 and 21' and the center of the front surface of the suction box 24. Thus the sheet S can be smoothly fed up and down along the sheet carrying side 22' of the suction belt 22.

Either suction portion selected according to the size of the sheet has to be moved downwardly so that it will stop exactly at the abovementioned reference position. For this purpose, a position sensor should preferably be provided near the conveyor unit 20 for exact positioning of the belt.

Figures 8, 9, 10, 11, 12:
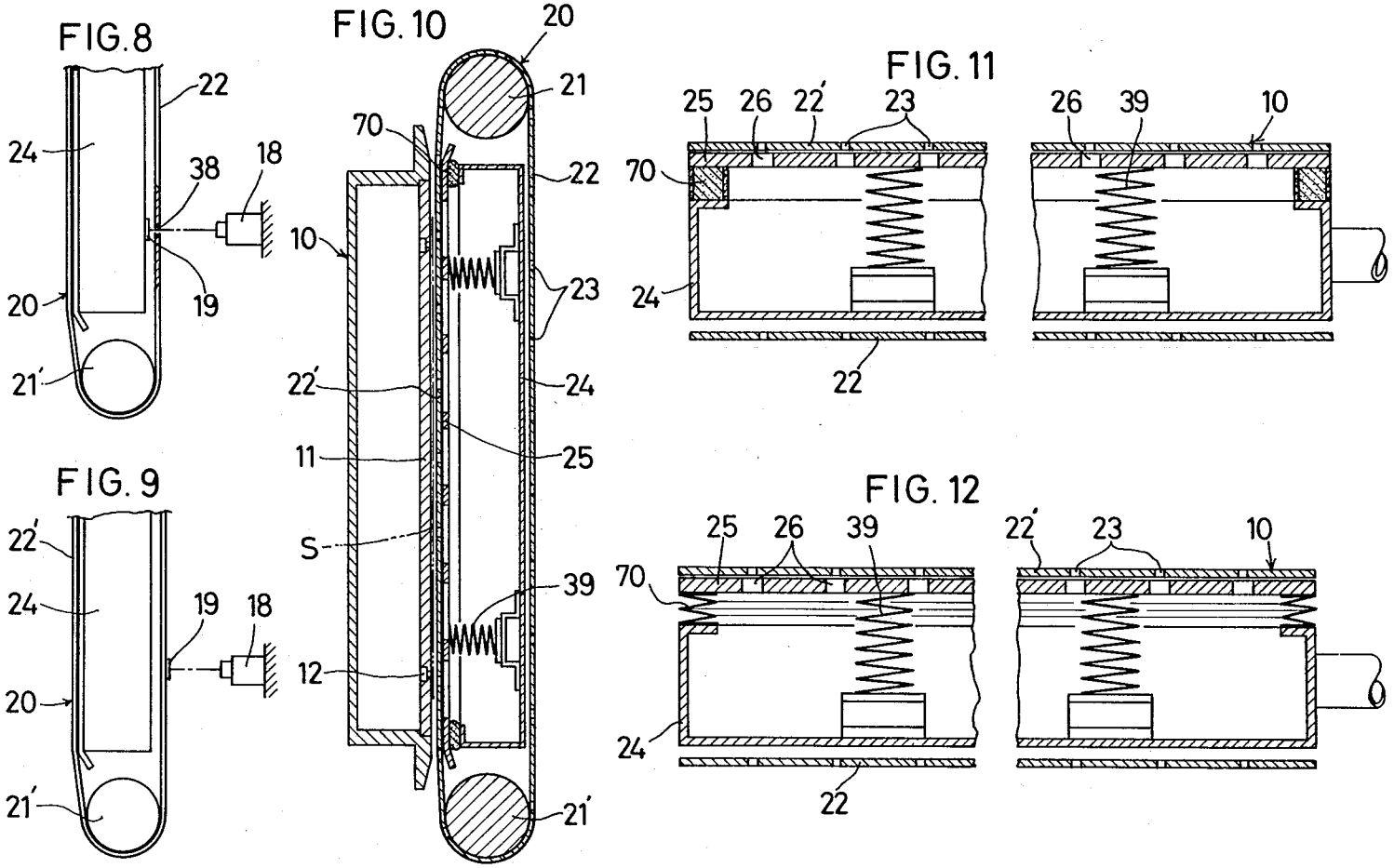
FIGS. 8 and 9 are side views showing two examples of the position sensor.
FIGS. 10–12 are sectional views of various examples of the suction box and the sheet guide plate.

FIG. 8 shows one example of the position sensor which comprises a reflex type optical sensor 18 provided near the suction belt 22 and a light reflecting tape 19 attached to the suction box 24 at a position opposite to the sensor 18. The suction belt is formed with a hole 38 at a predetermined position. The sensor 18 detects the tape 19 when the hole 38 gets aligned with the tape 19 and the sensor 18.

As shown in FIG. 9, the light reflecting tape 19 may be attached to the suction belt 22 at a predetermined position so that the sensor 18 can detect the belt position.

As shown in FIG. 10, the belt guide plate 25 may be urged forwardly by springs 39 mounted in the suction box 24. A resilient seal member 70 may be interposed between the guide plate 25 and the suction box 24 so as to surround their entire periphery. The seal member 70 may be of a spongy material as shown in FIG. 11 or a bellows made from resin-coated paper as shown in FIG. 12.

As the inside of the suction box 24 shown in FIG. 10 is evacuated, a suction force acts on the holes 23 formed in the sheet carrying side 22' of the belt 22 so as to suck the sheet S being fed downwardly to the belt 22. The sheet S thus attached to the belt is fed downwardly to a position opposite to the exposure table 10. The table 10 is then pressed against the sheet S to push the carrying side 22' of the belt and retract the belt guide plate 25.

If the sheet supporting plate 11 of the exposure table 10 is inclined when pressed against the sheet, the belt guide plate 25 will also incline in exact conformity with the inclination of the supporting plate 11. This is because the guide plate 25 is resiliently urged by the springs 9 toward the table 10. This will allow the supporting plate 11 to get into close contact with the sheet supported on the carrying side 22' of the belt 22. After the supporting plate 11 has been brought into close contact with the sheet, the suction box 24 is relieved from the suction force to hand the sheet over to the exposure table 10 which is now drawing the sheet by suction onto its supporting plate.

The exposure unit 40 is located at the other end of the travel of the carrier unit 1. As shown in FIG. 1, it comprises an original table 41, a light source 42 arranged under the table 41 to illuminate the original, a color separation filter assembly 43, lens 47 and a mirror 44. The light reflected by the original is directed to the mirror 44 through the filter assembly 43 and reflected by the mirror 44 so as to be hit against the photosensitive sheet S on the exposure table 10 at a right angle for light exposure.

The color separation filter assembly comprises a disk 45 formed with three openings in its peripheral portion and blue, green and red filters mounted on the disk so as to cover the openings. The disk 45 is rotated to bring the filters one by one into the path of light.

Between the exposure unit 40 and the conveyor unit 20, there are provided a corona charger 54 for corona charging the photosensitive sheet S, a corona discharger 57 for corona discharging it, and a development unit 50 for development it.

Next, the positioning mechanism for the exposure table will be described with reference to FIGS. 19 to 22.

The exposure table 10 is provided at its side facing the reciprocating plate 4 with a pair of positioning blocks 100 located at equal distances from the rotary shaft 8. Each positioning block 100 is formed with a groove 101 extending toward the rotary shaft 8 (FIG. 20).

Figure 19:
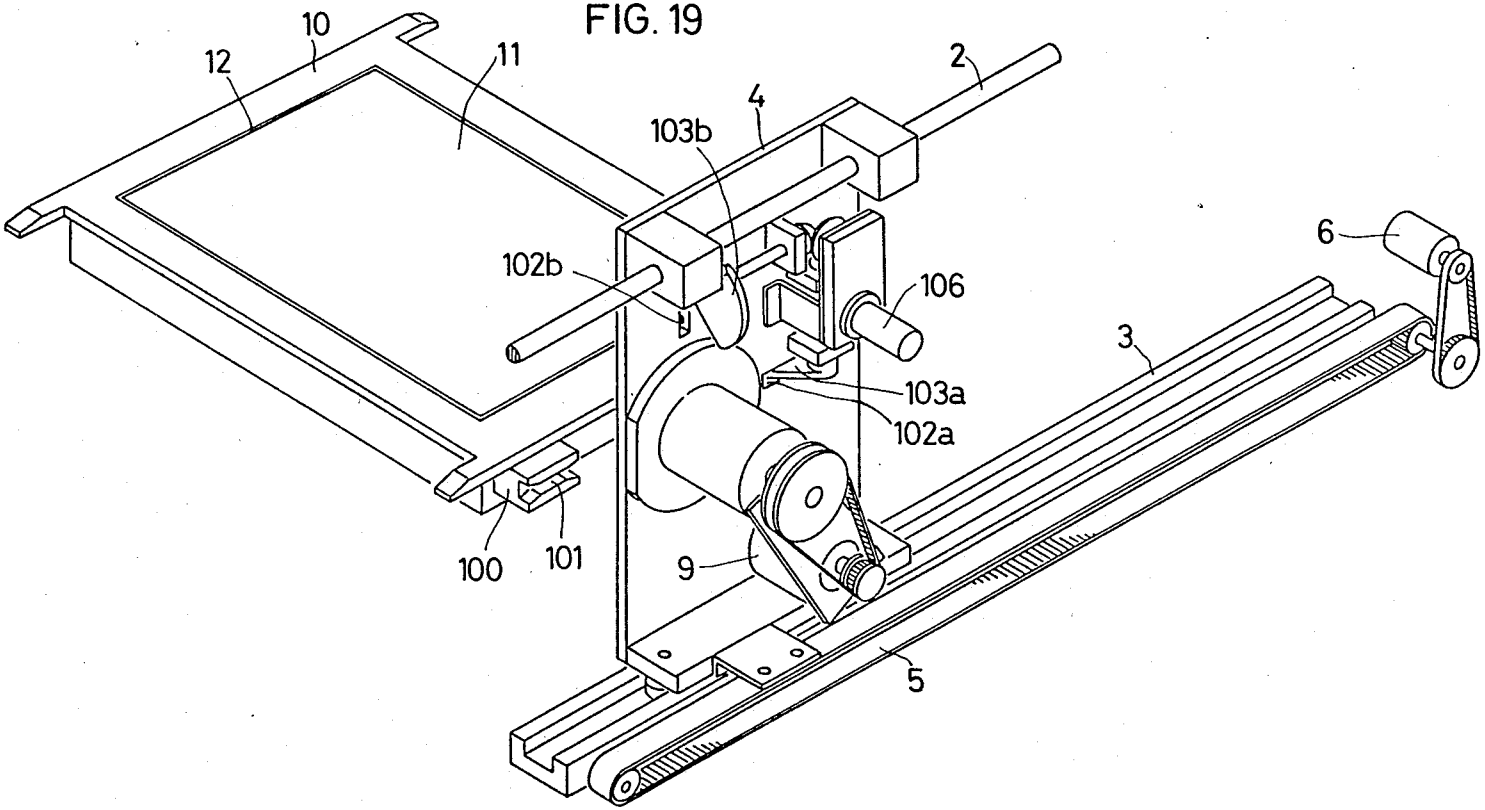
FIGS. 19–22 are views showing the mechanism for positioning the exposure table.
Figure 20:
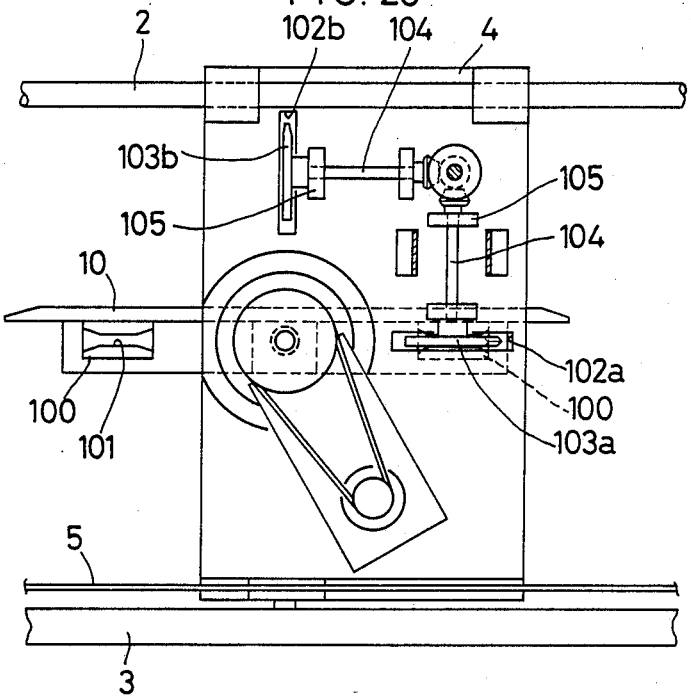

As shown in FIGS. 19 and 20, the reciprocating plate 4 is formed at side and over the rotary shaft 8 with slits **102*a* and 102*b*, respectively. The side slit 102*a* is adapted to face one of the grooves 101 when the exposure table 10 is in its horizontal position, whereas the upper slit 102*b* is adapted to face the other groove 101 when the exposure table 10** is in its upright position.

Behind the slits **102*a* and 102*b* fan-shaped plates 103*a* and 103*b* are supported on a pair of rotary shafts 104 which are supported by respective bearings 105 fixed to the backside of the reciprocating plate 4. The rotary shafts 104 are arranged at a right angle to each other and simultaneously driven by a motor 106 supported on a bracket 107**.

The fan-shaped plates 103*a* and 103*b* are adapted to be rotated by the motor 106 through the rotary shafts 104 so as to protrude their front ends to the front side of the reciprocating plate 4 through the slits 102*a* and 102*b*, respectively, and insert their protruding ends into the grooves 101. Each groove should preferably have its side walls at both ends tapered outwardly to facilitate the insertion of the plates 103*a* and 103*b*.

The plates 103*a* and 103*b* are mounted on the rotary shafts in such a manner that when one of the two plates is protruding its end into the front side of the reciprocating plate 3, the other plate is kept in its fully retracted position.

Figure 21:
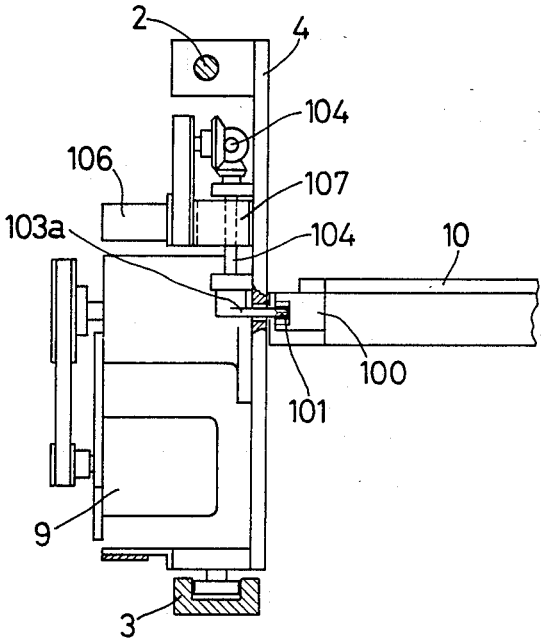
Figure 22:
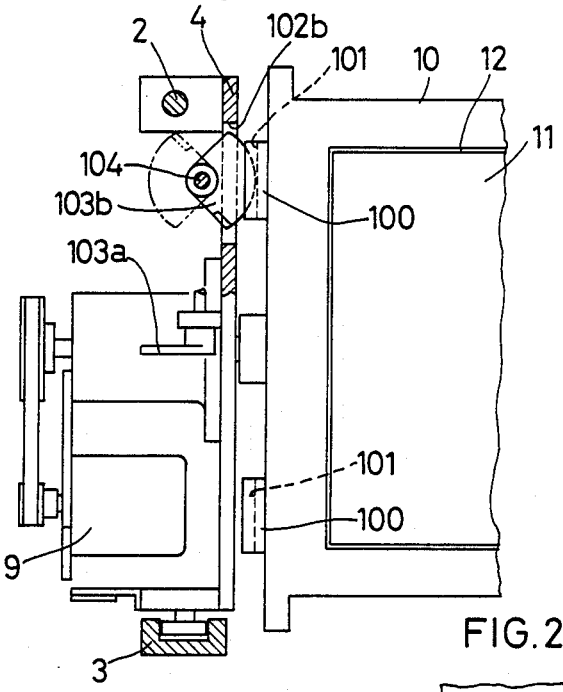

When the motor 9 is actuated, the rotary shaft 8 and thus the exposure table 10 are rotated until the table is brought to a horizontal position. Then, the motor 106 is actuated to protrude part of the plate 103*a* into the front side of the reciprocating plate 4 through the slit 102*a* and insert it into the slit 101 formed in the positioning block 100 which is now in a position opposite to the slit 102*a* as shown in FIG. 21. The exposure table 10 is thus held in its horizontal position.

When the exposure table 10 is in its upright position, the motor 106 is driven to protrude part of the plate 103*b* through the slit 102*b* into the front side of the reciprocating plate 3 so that it will engage in the groove 101 in the other positioning block 100 now located in a position opposite to the slit 102*b*. The exposure table 10 is thus restrained in its upright position.

The exposure table 10 can be held in its horizontal and upright positions exactly by the engagement between the plates 103*a* and 103*b* and the grooves 101 formed in the positioning blocks 100, even if the motor 9 should fail to bring the exposure table 10 to a desired exact position.

Figure 14:
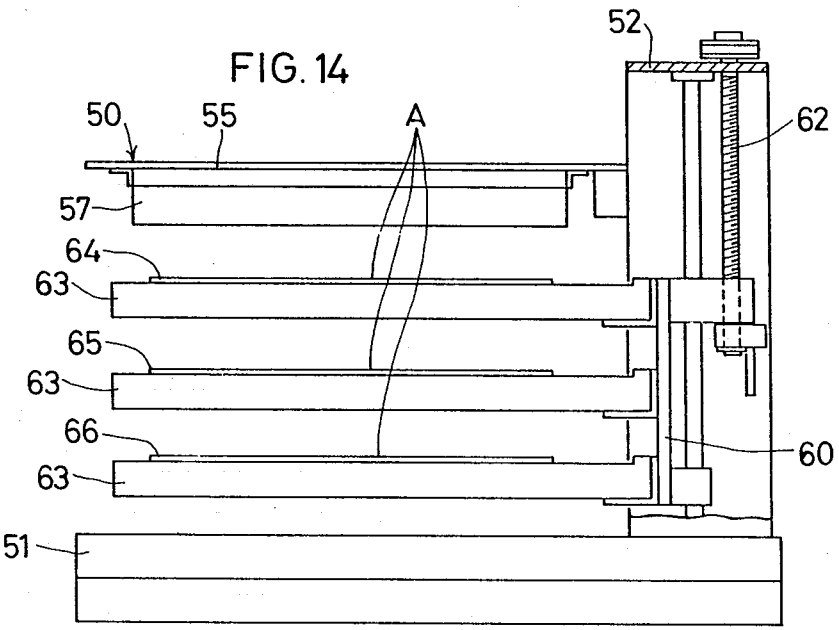
FIG. 14 is a side view of the same.
Figure 13:
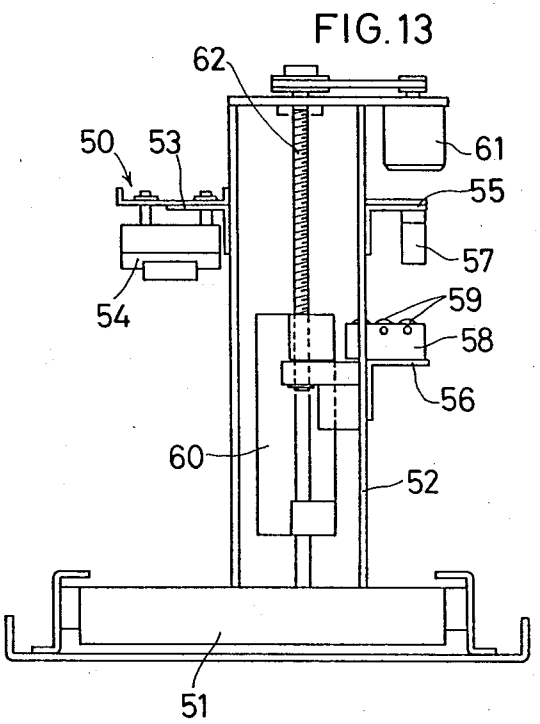
FIG. 13 is a front view of the development unit.

FIGS. 13 and 14 show the development unit 50 which comprises a base 51, a column 52 extending vertically from the top surface of the base 51, a shelf plate 53 mounted to the column at one side thereof, and a corona charger 54 mounted to the bottom of the shelf plate 53 to cause the photosensitive sheet S to be electrostatically charged while passing thereunder.

The unit 50 further includes upper and lower shelf plates 55 and 56 secured to the other side of the column 52 and a corona discharger 57 fixed to the bottom of the shelf plate 55 to corona discharge the photosensitive sheet S while it is passing thereunder. On the lower plate 56 is mounted a squeezer 58 for removing an excess of developing solution adhering to the developed photosensitive sheet passing over it.

The squeezer 58 has as many squeeze rollers 59 as the number of developing solutions. The squeeze rollers 59 are arranged in parallel in the direction of travel of the photosensitive sheet S. One of the rollers corresponding to each developing solution applied to the photosensitive sheet S is pushed up against the sheet to wipe off any excess solution. If necessary, air may be blown against the sheet S to remove any excess solution.

The column 52 also supports a vertically movable elevator plate 60 having one part thereof in threaded engagement with a threaded shaft 62, which is rotated by a motor 61 to move the elevator plate up and down. The elevator plate 60 has three tanks 63 cantilever-mounted, vertically spaced apart from one another so that the exposure table 10 can pass through the spaces therebetween. In each tank 63, first, second and third developing tanks 64, 65 and 66 are mounted, respectively. Yellow, magenta and cyan developing solutions are fed into the developing tanks 64, 65 and 66, respectively.

The development unit 50 may be fixed in a stationary position. But in the preferred embodiment, the unit 50 has its base 51 fixed to an endless chain 68 driven by a motor (not shown) so as to be movable in synchronism with the carrier unit 1 but in a reverse direction thereto.

Figure 15:
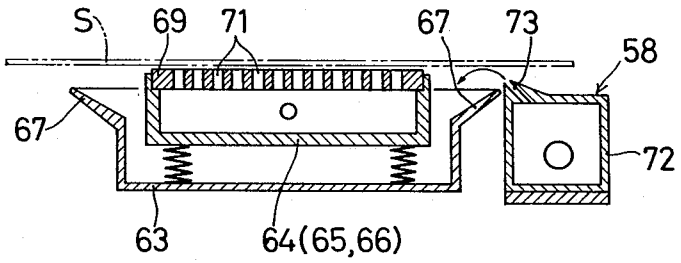
FIG. 15 is a sectional view of the collector tank, the developer tank and the squeezer unit.

Each collector tank 63 may have its brim 67 turned outwardly as shown in FIG. 15. Each of the developing tanks 64, 65 and 66 mounted in the collector tanks 63 has its top opening covered with an electrode plate 69. The electrode plate is formed with a plurality of apertures 71.

A developing solution is supplied into each developing tank until it overflows through the apertures 71 in the electrode plate 69 onto its top surface. The photosensitive sheet S subjected to light exposure is brought into contact with the developing solution filling the surface of the electrode plate.

An excess developing solution applied to the sheet S is removed by the squeezer 58 located behind the collector tanks 63 and supported by the column 52.

Figure 16:
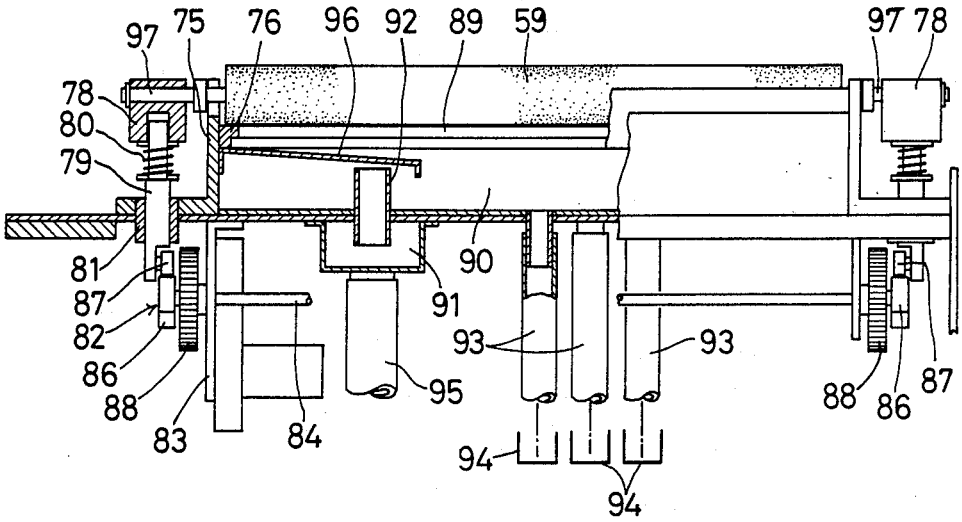
FIG. 16 is a side view of the squeezer unit.
Figure 17:
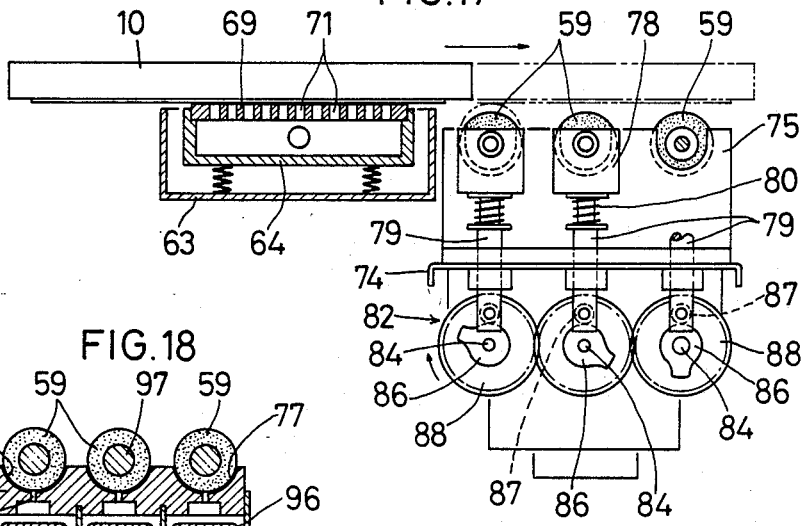
FIGS. 17 and 18 are sectional front views of the same.
Figure 18:
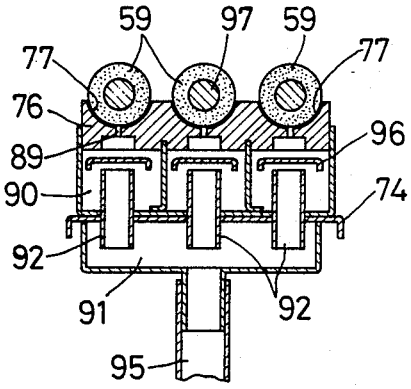

An embodiment of the squeezer 58 are shown in FIGS. 16 to 18. At the downstream side of the collector tanks 63, there is provided a table 74 upon which is mounted a roller support member 75 (FIG. 17). It has a roller support plate 76 formed in its top surface with semi-cylindrical grooves 77 to receive the squeeze rollers 59. If the apparatus of the present invention is a color electrophotographic copying apparatus, it should be provided with three roller receiving grooves 77 arranged in parallel to one another in the direction of feed of the photosensitive sheet S.

The squeeze rollers 59 made of a liquid absorbent material are received in the grooves 77. Each squeeze roller 59 has its both ends journaled in bearings 78. Under each bearing, a rod 79 is slidably provided around which is mounted a spring 80 supporting the bearing 78. The rod 79 slidably extends through a guide sheath 81. The rods 79 are moved up and down by an elevator 82. The rods 79 are selectively pushed up to bring the respective rollers 59 into contact with the photosensitive sheet S.

The elevator 82 comprises brackets 83 suspended from the table 74, three cam shafts 84 passing through the brackets 83, cams 86 mounted on the shafts 84 at both ends and cam followers 87 kept in contact with each cam 86 and having their top end pivotally connected to the lower end of each rod 79. Thus, the squeeze rollers 59 are moved up and down with the rotation of the cams.

The squeeze rollers 59 are so adapted that one of the three rollers will be selectively pushed up into contact with the photosensitive sheet according to the kind of the developing solution applied thereto. The cam shafts 84 are linked together by gears 88 so that their rotations will be synchronized with one another. The cams 86 for the respective cam shafts have their cam surfaces shaped in such a manner that the squeeze rollers 59 will be pushed up one after another from one end toward the other.

A suction slit 89 is formed in each roller receiving groove 77 formed in the roller support plate 76 so as to extend in the axial direction of the rollers 59. The slits 89 communicate with three independent suction chambers 90 formed under the roller support plate 76, respectively. The suction chambers 90 in turn communicate with a suction duct 91 formed under the table 74 through respective suction pipes 92. Thus, by evacuating the suction duct 91 through a suction hose 95 connected thereto, a suction force is applied to the suction slits 89. To the bottom of each suction chamber 90 is connected a collector pipe 93 which is in turn connected to each liquid reservoir 94.

When the elevator 82 is actuated, one squeeze roller 59 is raised to such a position as to get into contact with the photosensitive sheet S. The sheet is then passed over the roller 59 to remove any excess developing solution by contact with the roller.

After removing any excess solution, the roller is lowered into its respective groove 77. A suction force is then applied to the suction duct 91 to suck the developing solution filling the squeeze roller. The developing solutions are removed from the rollers every time they are lowered into the grooves. Thus, the rollers 59 are kept from being saturated with developing solutions and can reliably remove excess solutions adhering to photosensitive sheet S.

The developing solutions sucked from the squeeze rollers 59 are directed to the liquid reservoir 94 through the suction hoses 95, the suction chambers 90 and collector pipes 93. In order to prevent the solutions from flowing into the suction hose 95 through the suction pipes 92 and the suction duct 91, each suction pipe 92 should be covered with a shield plate 96.

The squeezer 58 may be provided with an air blow duct 72 extending in a transverse direction of travel of the exposure table 10. (FIG. 15) The duct is formed with an air blow slit 73 in its top surface. The compressed air fed into the duct 72 will be blown out of the slit 73 against the photosensitive sheet S on the exposure table 10 to blow off any excess developing solution adhering to the sheet. The developing solution removed from the sheet flows into the collector tanks 63 through the squeezer 58.

Next, we shall describe how the exposed sheet is delivered to the stacker table 35 through the delivery conveyor 34.

The fixed guide plate 32 disposed at the upper portion of the sheet conveyor unit 20 has its upper part inclined obliquely toward the delivery conveyors 34 and its lower part juxtaposed to the carrying side 22' of the suction belt 22 so as to define a path for the photosensitive sheet therebetween.

The pivotable guide plate 31 is provided at both sides thereof with pins 109 pivotally mounted on support plates 108 provided at both sides of the fixed guide plate 32. The pivotable guide plate 31 is kept upright when a web of photosensitive paper is being fed to the conveyor unit 20 from the magazine 27. When the developed photosensitive sheet stuck to the carrying side 22' of the suction belt 22 is fed upwardly, the guide plate 31 is inclined to guide the sheet S upwardly and obliquely in cooperation with the fixed guide plate 32. The guide plate 31 may be pivoted by means of a rotary solenoid or may be adapted to pivot with the rotation of the upper roller 21 as in the preferred embodiment.

Figure 23:
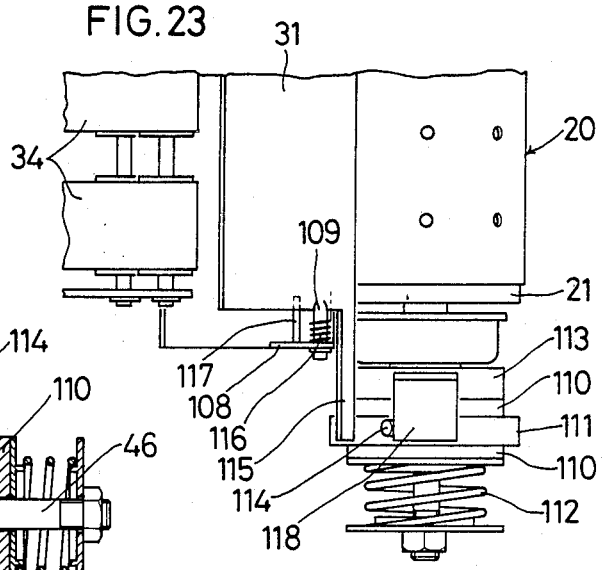
Figure 24:
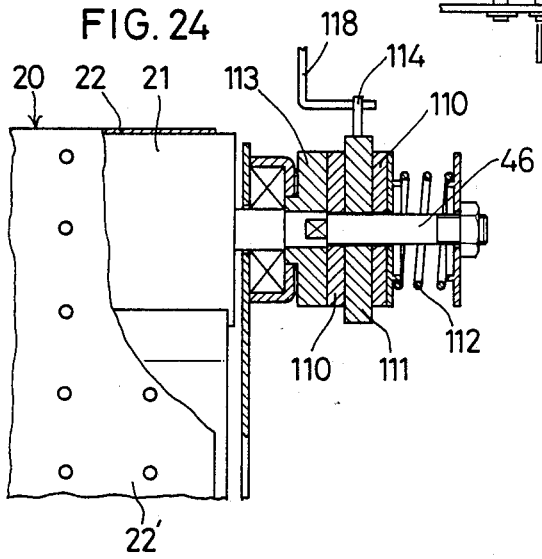
Figure 25:
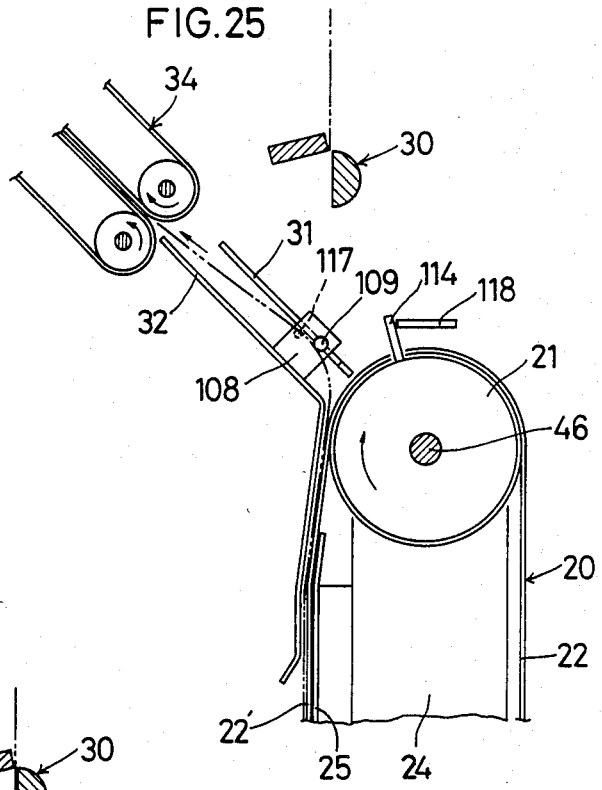

FIGS. 23 to 25 show a mechanism for pivoting the movable guide plate 31. A pair of friction plates 110 and a friction ring 111 sandwiched therebetween are mounted on a roller shaft 46 of the upper roller 21 at its protruding end and are normally urged by spring 112 against a torque transmitting plate 113 fixedly mounted on the roller shaft 46. A pin 114 is provided on the outer periphery of the friction ring 111. The guide plate 31 is provided at one side near the pivoting mechanism with a projection 115 adapted to abut the pin 114.

Further, a spring 116 is mounted around the pin 109 protruding from the one side of the guide plate 31. The spring 116 serves to bias the guide plate 31 into abutment with a stopper pin 117 provided on the support plate 108 at one side of the guide plate 31.

Figure 26:
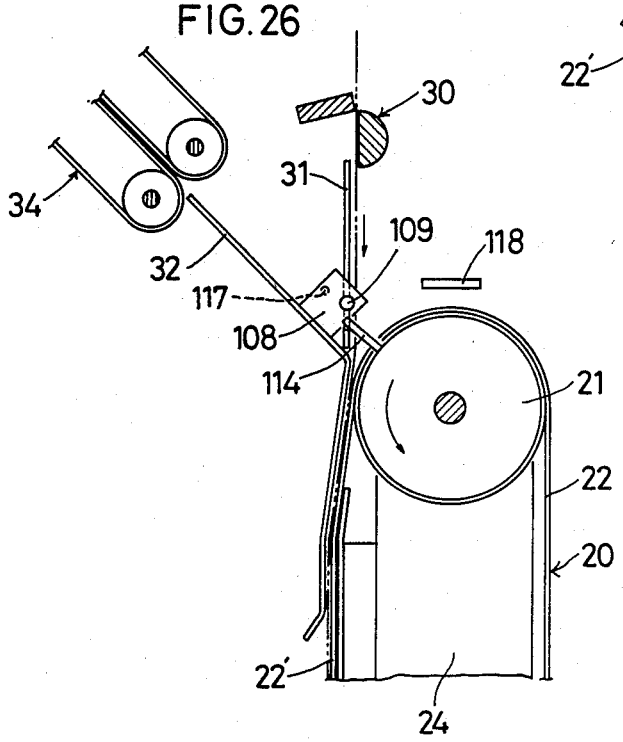

With this arrangement, when the upper roller 21 is rotated in the direction shown by arrow of FIG. 26 to feed the photosensitive sheet downwardly, the friction ring 111 is rotated with the upper roller 21 to cause the pin 114 to butt the projection 115 and thus to pivot the guide plate 31. The guide plate 31 pivots until it is brought to an upright position where its lower end butts the fixed guide plate 32, restraining the friction ring 111 from rotating with the roller 22 any further. Thus, the friction ring 111 slips against the friction plates 110.

When the roller 21 rotates in the direction shown by arrow of FIG. 25 to feed the photosensitive sheet S upwardly, the friction ring 111 will rotate with the roller 21 to move the projection 115 away from the pin 114 and to allow the guide plate 31 to pivot back to its inclined position urged by the spring 116 until it abuts the stopper pin 117. The pin 114 is adapted to abut a stopper 118 provided over the roller 21. Thus the friction ring 111 is restrained from rotating any further.

The developed photosensitive sheet is guided between the pivotable guide plate 31 and the fixed guide plate 32 toward the inlet end of the delivery conveyors 34 disposed at the leading end of the fixed guide plate 32 and carried by the conveyors 34 to the stacker table 35.

Next, we shall now describe the operation with reference to FIGS. 27 to 30.

When the photosensitive sheet S cut to a desired length is fed onto the carrying side 22' of the suction belt 22 of the conveyor unit 20 which is shown in detail in FIG. 5, it will be further fed downwardly by the suction belt 22 while being sucked thereto.

The feed of the photosensitive sheet stops at a predetermined reference position. The carrier unit 1 now in its upright position is moved toward the suction belt 22 until its supporting plate 11 is pressed against the suction belt 22 with the photosensitive sheet sandwiched therebetween. Then the suction force acting on the sheet through the suction apertures 23 in the suction belt 22 is turned off and at the same time, a suction force is applied to the suction groove 12 in the supporting plate 11 of the exposure table 10. The exposure table now having the sheet S on its supporting plate 11 moves toward the exposure unit 40.

Figures 27A, 27B, 27C, 27D:
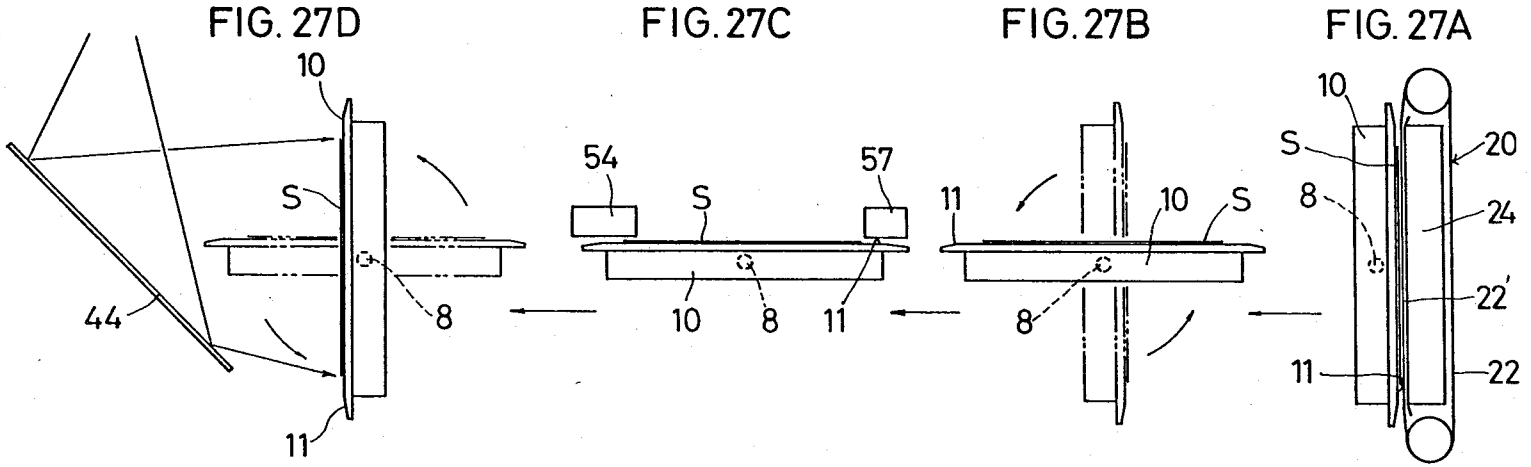

Immediately before the development unit 50, the exposure table 10 is turned by 90 degrees so that its sheet supporting surface will face up (FIG. 27A) and move toward the exposure unit 40 again. When the table 10 passes through the development unit 50, the sheet is corona charged by the corona charger 55 as shown in FIG. 27C. After the first image-creating step, the sheet may be discharged by the corona discharger 57, if necessary.

The charged sheet S will move to the exposure unit 40 and stop at a position shown in FIG. 27D. Then it is turned by 90 degrees so that the sheet S will face the mirror 44. The light reflected by the original is passed through one of the three color separation filters 43 and the lens 47 and irradiates the sheet, subjecting it to the first light exposure. E.g. a blue separation filter is used in the first exposure step.

The exposure table 10 is turned further by 90 degrees to put its sheet supporting surface down (as shown by full line of FIG. 28A) and sent toward the conveyor unit 20. When the exposure table 10 passes through the development unit 50 on its way to the conveyor unit 20, the sheet is developed by contact with e.g. a yellow developing solution and then brought into contact with one of the squeeze rollers 59 to remove any excess developing solution.

When the sheet is brought into contact with the developing solution, the color toner (yellow) dispersed in the solution will migrate into the sheet so as to be deposited on the electrostatic latent image on the sheet. A color toner image is thus created on the photosensitive sheet S.

Figures 28A, 28B, 28C, 29, 30:
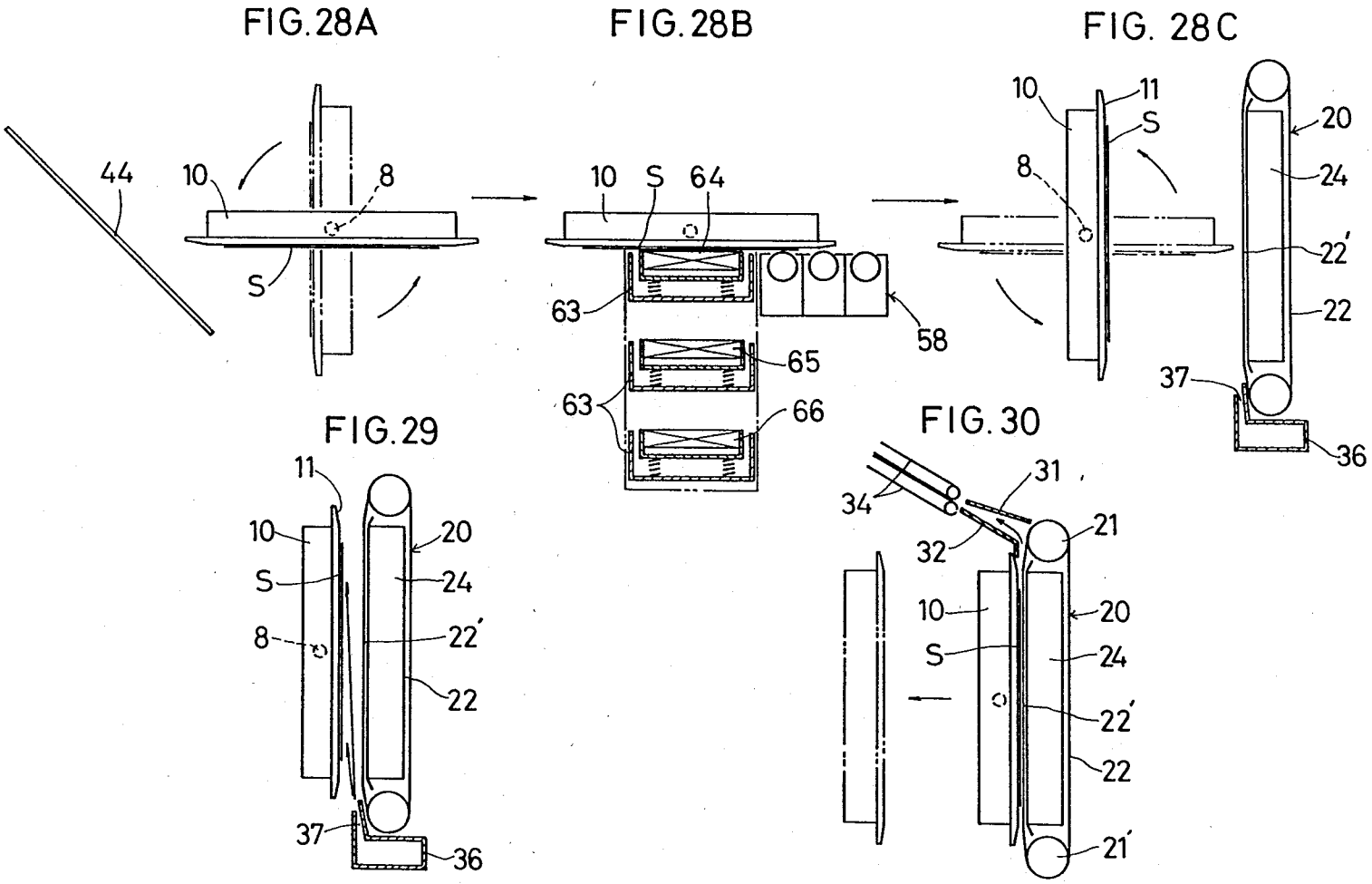

The table is then sent toward the conveyor unit 20 and stopped before it as shown in FIG. 28C. The table is turned by 180 degrees there to bring its sheet supporting surface up again to such a position as shown in FIG. 27B.

As shown in FIGS. 27B to 28C, one developing cycle comprises the steps of electrification, light exposure, development and destaticization. This cycle is repeated as many times as the number of developing units required.

In the second developing cycle, the green separation filter 43 is used for light exposure and in the third cycle, the red separation filter is used, for example.

Every time one developing treatment is finished, the elevator plate 60 shown in FIG. 14 is raised one pitch to bring the second developing tank 65 and the third tank 66 to the position opposite to the photosensitive sheet in the second and third developing cycles, respectively. Thus, the photosensitive sheet S will be developed with a developing solution containing magenta color toner in the second developing cycle and with a developing solution containing cyan color toner in the third cycle, respectively.

Upon completion of the third development cycle, the exposure table 10 turns by 90 degrees from the position shown by chain line of FIG. 28C so that the photosensitive sheet will face the suction belt 22. The exposure table 10 is moved toward the suction belt. As the table comes close to the suction belt 22, hot air is blown out of the box 36 through its outlet 37 to dry the sheet as shown in FIG. 29.

After drying, the exposure table is pressed against the suction belt 22 to hand the photosensitive sheet over to the suction belt 22 as shown in FIG. 30. The table 10 subsequently withdraws to the position shown by chain line in FIG. 30 whereas the photosensitive sheet adhering to the suction belt 22 is fed upwardly and onto the stacker table 35 (FIG. 1) by means of the delivery conveyors 34.

According to the present invention, the steps of electrification, development and destaticization steps are carried out while the exposure table 10 and the development unit 50 are moving in opposite directions. Thus, the entire time required can be shortened and the size of the apparatus can be reduced. In the preferred embodiment, an image is created on the photosensitive sheet by use of three colors, one color in each developing cycle. But, of course, an image can be created with one or two colors selected from among four colors i.e. magenta, yellow, cyan and black.

In the preferred embodiment, a web of photosensitive paper drawn out of a roll of paper is cut to a plurality of sheets of a desired length to feed them to the conveyor unit 20. Instead of a roll of paper, a plurality of sheets cut beforehand to a desired length may be stacked up in the paper feed means and they may be fed to the conveyor unit one by one.

What is claimed is:

1. An electrophotographic copying apparatus comprising a carrier means for transferring a photosensitive sheet including a reciprocating plate movable between two positions, a rotary shaft rotatably mounted on said reciprocating plate and an exposure table fixedly mounted on said rotary shaft and adapted to suck and support said photosensitive sheet, a conveyor means provided near one of said two positions and including an endless suction belt for feeding said photosensitive sheet up and down, said conveyor means being a dated to exchange said photosensitive sheet between said suction belt and said exposure table by turning on and off suction force with said photosensitive sheet sandwiched therebetween, a corona charging means for electrostatically charging said photosensitive sheet disposed in the path of travel of said carrier means, a light exposure means disposed near the other of said two positions and adapted to irradiate the photosensitive sheet on said exposure table which is held in an upright position with light reflected by an original, and a developing means for bringing the photosensitive sheet exposed to light into contact with a developing solution.

2. An electrophotographic copying apparatus as claimed in claim 1, wherein said light exposure means further comprises a plurality of color separation filters and said developing means is adapted to bring the exposed photosensitive sheet into contact with a plurality of developing solutions one after another according to a predetermined development order.

* * * * *

UNITED STATES PATENT AND TRADEMARK OFFICE

CERTIFICATE OF CORRECTION

PATENT NO. : 4,908,667

DATED : March 13, 1990

INVENTOR(S) : IKEURA et al

It is certified that error appears in the above-identified patent and that said Letters Patent is hereby corrected as shown below:

On the cover page, after Item [22], the following should appear:

--[30] Foreign Application Priority Data

| | | | |
|---|---|---|---|
| Jul. 17, 1987 | [JP] | Japan | 62-179828 |
| Jul. 20, 1987 | [JP] | Japan | 62-181859 |
| Jul. 27, 1987 | [JP] | Japan | 62-115713[U] |
| Jul. 27, 1987 | [JP] | Japan | 62-115714[U] |
| Jul. 27, 1987 | [JP] | Japan | 62-115715[U] |
| Jul. 27, 1987 | [JP] | Japan | 62-115716[U] |
| Jul. 28, 1987 | [JP] | Japan | 62-189886 |
| Jul. 28, 1987 | [JP] | Japan | 62-116434[U] |
| Jul. 28, 1987 | [JP] | Japan | 62-116435[U]--. |

Signed and Sealed this

Twentieth Day of August, 1991

*Attest:*

*Attesting Officer*

HARRY F. MANBECK, JR.

*Commissioner of Patents and Trademarks*